US008486237B2

(12) United States Patent
Krishna et al.

(10) Patent No.: US 8,486,237 B2
(45) Date of Patent: Jul. 16, 2013

(54) PROCESS FOR CONTINUOUS COATING DEPOSITION AND AN APPARATUS FOR CARRYING OUT THE PROCESS

(75) Inventors: Lingamaneni Rama Krishna, Hyderabad (IN); Nitin Pandurang Wasekar, Hyderabad (IN); Govindan Sundararajan, Hyderabad (IN)

(73) Assignee: International Advanced Research Centre for Powder Metallurgy and New Materials (ARCI), New Delhi (IN)

( * ) Notice: Subject to any disclaimer, the term of this patent is extended or adjusted under 35 U.S.C. 154(b) by 620 days.

(21) Appl. No.: 12/579,002

(22) Filed: Oct. 14, 2009

(65) Prior Publication Data

US 2010/0163421 A1 Jul. 1, 2010

(30) Foreign Application Priority Data

Oct. 16, 2008 (IN) ..... 1829/DEL/08

(51) Int. Cl.
*C25B 9/00* (2006.01)
*C25D 17/00* (2006.01)
*C25D 5/00* (2006.01)

(52) U.S. Cl.
USPC ..... 204/275.1; 205/137; 205/138; 205/316; 205/333; 204/202

(58) Field of Classification Search
USPC ..... 204/275.1
See application file for complete search history.

(56) References Cited

U.S. PATENT DOCUMENTS

| | | | | |
|---|---|---|---|---|
| 5,616,229 | A | 4/1997 | Samsonov et al. | |
| 5,804,053 | A * | 9/1998 | Vaccaro et al. | 205/138 |
| 6,197,178 | B1 * | 3/2001 | Patel et al. | 205/81 |
| 6,893,551 | B2 * | 5/2005 | Krishna et al. | 205/316 |

FOREIGN PATENT DOCUMENTS

| | | |
|---|---|---|
| IN | 209817 | 12/2007 |

* cited by examiner

*Primary Examiner* — Harry D Wilkins, III
*Assistant Examiner* — Bryan D. Ripa
(74) *Attorney, Agent, or Firm* — The Webb Law Firm

(57) ABSTRACT

An apparatus for continuously forming thin ceramic coatings on metal sheets, foils or wires. The apparatus has a reaction chamber, perforated nylon sheets, nylon bar guides, copper rods attached to a power supply, nylon collecting rods, and an inlet and an outlet. The reaction chamber is capable of containing an electrolytic solution. The copper rods are separately connected to the R, Y, or B phase of the power supply. Each phase is provided with two thyristors and the output of the thyristors is connected to the copper rods using current transformers. A process for continuously forming thin ceramic coatings on metal sheets, foils or wires is also provided.

15 Claims, 2 Drawing Sheets

PROCESS FOR CONTINUOUS COATING DEPOSITION AND AN APPARATUS FOR CARRYING OUT THE PROCESS

BACKGROUND OF THE INVENTION

1. Field of the Invention

The invention relates to a process for continuous coating deposition and an apparatus for carrying out the process. The invention more particularly relates to a process for forming oxide based ceramic coatings on reactive metal and alloy sheets, foils and wires that are in the form of a web in a continuous manner and an apparatus therefor. The films obtained according to the present invention have a glossy surface finish, thermal and electrical insulation, chemical inertness, environmental inertness, surface cleaning ability, anti-dust sticking and have good scratch resistance. Further, the process described in the present invention deposits the oxide ceramic films at a rapid rate and enhances the productivity to a great extent.

2. Description of Related Art

The metals like Al, Ti, Mg and their alloys are commercially and widely used in the engineering industries like automobile, aerospace, textile, petrochemical and crockery in the form of rods, bars, tubes, foils, sheets, wires, pipes, channels, sections, pulleys, cylinders, pistons, etc. Apart from the specific promising properties and commercial availability that these materials have, the main reason for using these materials is their high strength to weight ratio. However, there exists a limitation to use these materials beyond a certain point; the limitation arises from the fact that these materials exhibit poor resistance to wear and tear, chemical attack and heat.

Traditionally, anodizing is employed to obtain coatings on Al-alloys. But the resultant coatings are found to be porous and weakly adherent to the substrate, and thereby can not provide high level protection against wear and tear and corrosion. Moreover, coating deposition rates achieved are also low in the anodizing process.

Thermal spraying techniques like plasma spraying, high velocity oxy-fuel spraying, and detonation spraying are well developed and widely used by the engineering industry to produce large varieties of metallic, oxide, carbide and nitride based ceramic coatings. These coatings are essentially employed to combat various forms of wear and tear and corrosion and thereby enhance the service life of the components made of different metals and alloys. However, thermal spray techniques demand a high degree of pre-coating and post-coating operations that are often costly. Size, shape and complexity in geometry of the engineering components do restrict the applicability of the thermal spray techniques. Moreover, these techniques demand high quality as well as costly powders such as Alumina, Alumina-Titania, Tungsten Carbide-Cobalt, Chromium Carbide-Nickel Chrome prepared by specially developed manufacturing routes such as sol-gel, atomization, fusing, sintering and crushing, chemical reduction and blending. Deposition efficiency of these powders is always much less than 100% thus requiring a special means of unused powder separation from the coating chamber. Since these coating techniques employ spraying of heated powder particles on to relatively cold surfaces, poor metallurgical bonding between the substrate and the coating often results. These coatings are often characterized by inherent porosity, micro-cracks and higher levels of residual stresses which in turn lead to the failure of the coatings in the case of critical applications. Due to the associated coating deposition mechanism, the thermal spray techniques are not at all suitable to deposit thin films on sheets, foils and wires.

Moreover, it is not practically possible to deposit thin coatings on thin sheets, foils and wires in a continuous manner.

Yet another field of research in the area of thin film deposition on sheets, foils and wires is by means of Physical Vapor Deposition (PVD) and Chemical Vapor Deposition (CVD) techniques. However, due to the inherent nature of these processes wherein the overall coating deposition is significantly influenced by the ionic/atomic scale interactions with the surfaces being coated, the overall coating deposition rates are extremely low and production rates are very low. Besides the slow deposition nature of these processes, these techniques are also not suitable for coating deposition on a continuous scale on extremely larger/longer surface areas.

To overcome the above-mentioned difficulties and limitations and the present day need for coatings exhibiting improved tribological, electrical, thermal and chemical properties and having higher density and excellent wear resistance, research work in the area of developing an improved micro-arc oxidation process has gained importance globally.

There exist a good number of patents and publications which deal with ceramic coating deposition processes on aluminum and its alloys. Some relevant literature on prior art micro-arc processes is referred to below.

According to U.S. Pat. No. 6,197,178, a three-phase pure sinusoidal potential of 480V AC electrical power is supplied to aluminum alloy web and current densities between 20 and 70 $A/dm^2$ are applied. During the process, current density is maintained by moving the web relative to each other. An electrolyte with KOH, $Na_2SiO_3$ and $Na_2O.Al_2O_3.3H_2O$ in the proportion of 2 grams per liter of de-ionized water is used. That temperature of the electrolytic bath is maintained between 25° C. and 80° C. The coating thickness achieved is reported to be in the range of 100 to 160 microns for a 30 minute processing time on cylindrical samples.

Although the resultant coatings were found to have strong adherence with the substrate, no information is available with respect to the density and uniformity of the coatings achieved. Coating density is a very important parameter that affects the wear resistance of the resulting coatings.

In the invention cited above, the inventors used a pure sinusoidal voltage waveform without any waveform modification, while a sharply-peaked waveform makes a major contribution in providing a dense and hard coating. This is why the coatings obtained through the above-mentioned process exhibit lower hardness, i.e., 1200-1400 $kg/mm^2$. However, there is no mention of the application of the said process to deposit coatings on thin sheets, foils and wires or to do so in a continuous manner.

U.S. Pat. No. 5,616,229 granted to Samsonov et al. discloses a method of forming a ceramic coating on valve metals. This method comprises application of at least 700V alternating current across the parts to be coated. Waveform modification is achieved through a capacitor bank connected in series between a high voltage source and the metallic body to be coated. Waveform of the electric current rises from zero to its maximum height and falls to below 40% of its maximum height within less than a quarter of a full alternating cycle.

The electrolyte used in the above cited process contains 0.5 grams/liter NaOH, 0.5-2 grams/liter KOH. In addition, the electrolyte also contains sodium tetrasilicate for which there is no claim on the exact amount to be added. During the process, the electrolyte composition is changed by adding oxyacid salt of an alkali metal in a concentration range of 2 to 200 grams per liter of solution. The process has been demonstrated by coating an aluminum alloy known as Duralumin by employing three different electrolytic baths. However, in the process explained above there is no mention of maintaining any particular ratio between the alkali and metal silicate.

In the micro-arc oxidation process, alkali is actually responsible for dissolving the coating, whereas the metal silicate is responsible for coating buildup through poly condensation of silicate anions. Too high silicate concentration in the electrolyte causes higher coating buildup especially at sample edges rather than at other portions of the sample thus resulting in a non-uniform coating. Hence, there is a need to maintain a certain degree of proportion between the alkali and metal silicate in order to end up with uniform and dense coatings. However, there is no mention of the application of the said process to deposit coatings on thin sheets, foils and wires or to do so in a continuous manner.

In the process disclosed in U.S. Pat. No. 5,616,229 a process is described wherein an average deposition rate of 2.5 micron per minute has been achieved. However, the thickness of a fully melted inner layer is only 65 microns out of a total coating thickness of 100 microns. This indicates that this process can produce coatings comprising only 65% initial dense layer and remaining 35% external layer is porous with 4-6 pores per sq. cm. and an average pore diameter of 8-11 microns.

To make these coatings suitable for wear resistant applications, the external porous layer of sufficient thickness needs to be completely removed by machining or grinding. Apart from the fact that these machining or grinding operations are costly, machining/grinding of coated parts of complex, non-symmetric shapes is extremely difficult and demands a high degree of automated machinery and higher skill levels. This effectively increases the cost of the coating per unit volume. However, there is no mention of the application of the said process to deposit coatings on thin sheets, foils and wires or to do so in a continuous manner.

The prior art processes of micro-arc oxidation processes yielded thick dense, adherent coatings with higher coating deposition rates but failed to produce thin films on a continuous scale so as to coat several meters and kilometers long sheets or foils and wires wherein it is essentially required to impart a glossy surface finish, thermal and electrical insulation, chemical inertness, surface cleaning ability, environmental inertness, anti-dust sticking and have good scratch resistance to find potential applications in the field of decorative, insulation, anti-dust sticking applications.

Moreover, in the prior art, the processes employed for coating metallic web has been discussed in detail, but nothing has been disclosed about the general apparatus employed for carrying out the coatings on thin sheets, foils and wires or to do so in a continuous manner process in continuous scale.

According to the invention disclosed in U.S. Pat. No. 6,197,178, the apparatus employed for obtaining the coating consists of a chemically inert coating tank disposed within an outer tank. The outer tank contains heat exchange fluid. Electrolyte from the inner tank is circulated through the heat exchange disposed in the outer tank itself. To remove heat from the heat exchange fluid, heat exchange fluid is withdrawn from the outer tank with the help of a pump and then passed through a forced air cooled heat exchanger. The operation of the exchangers was controlled automatically so as to maintain the desired temperature within the electrolyte bath. However, there exists a serious drawback with this kind of setup. When a component of larger size than that of the inner coating tank is to be coated, the dimensions of the inner tank must be increased, which in turn may demand changing the outer tank dimensions as well. This makes the process more costly.

In our Indian Patent No. 209817, the following process has been described:

A process for forming coatings on bodies of reactive metals and alloys which comprises electrolysing in a non-metallic, non-reactive, non-conductive reaction chamber containing an alkaline electrolytic solution having a pH>12 and conductivity>2 millimhos, comprising potassium hydroxide, sodium tetrasilicate and de-ionized or distilled water, immersing at least two metallic bodies selected from the reactive group of metals on which coatings have to be effected, the bodies being fixed in a movable manner, each body being connected to an electrode, passing wave multiphase alternating current across the said bodies by thyristors connected in parallel for a period based on the desired thickness of the coating to be achieved, slowly increasing the current being supplied to the said bodies until the required current density is achieved, then maintaining the current at the same level throughout the process, the electric potential being further increased gradually to compensate for the increasing resistance of the coating when the visible arcing at the surface of the immersed regions of the said bodies is noticed, regulating the composition of the electrolyte by measuring its pH and conductivity during the process by conventional methods, maintaining the temperature of the electroyte between the range of 4° C. to 50° C. and keeping the electrolyte in continuous circulation throughout the process.

The patent also discloses an apparatus for carrying out the process. The apparatus disclosed in the patent is shown in FIGS. 1, 2, and 3 of the first sheet of drawings accompanying this specification. In the drawings:

FIG. 1 represents a front view of a coating apparatus for carrying out the process disclosed in the prior art Indian patent;

FIG. 2 represents a front view of a main control panel for carrying out the process disclosed in the patent; and FIG. 3 represents a front view of a remote control panel for carrying out the process disclosed in the patent.

The apparatus for carrying out the process as disclosed in the patent comprises a non-metallic, non-conductive, non-reactive chamber (1) (named as reaction chamber) housing at least two metallic bodies (2), the surfaces of which are to be coated, the bodies being connected to the electrical power carrying arm (3) provided with a height adjustable mechanism (4), an inlet (5) for the electrolyte provided at the bottom, and an outlet (6) at the top of the chamber, on the panel of main controller (8), analog voltmeter (9), and ammeter (10) being provided to indicate the input voltage and current, a lever type electric power on/off (11) being provided, a potentiometer (12) provided for slowly increasing the current supply to the metallic bodies (2), contractor on/off (13), thyristor on/off (14) switches, manual/automatic voltage adjustment (15), and local/remote operation (16) selector switches being also provided, thyristor (not shown) and transformer (17) outputs being connected through the separate analog voltmeters (18) and ammeters (19), two separate digital temperature indicators (20) being attached to the panel of remote controller (21), the temperature of electrolyte at the inlet and outlet being measured through the thermocouples (not shown), an oscilloscope (22) attached to the remote controller (21) for monitoring the electrical potential and current waveforms during the process, digital voltmeter (23) and ammeter (24) attached to the remote control panel (21) being used to monitor the changes in the current and voltage during the coating process, the height of electrolytic column (7) in the reaction chamber (1) being adjusted through a dimmerstat (25) attached to the panel of remote controller (21) and an emergency stop button (26) being attached to the remote control panel (21) for terminating the electrical power supply to the bodies in the case of any emergency.

The drawbacks of the apparatus disclosed in our earlier Indian Patent No. 209817 are listed below:

1. the apparatus is not suitable for depositing thinner coatings on large area surfaces;
2. the apparatus is not suitable for depositing coatings on thin foils, sheets and wires;
3. the apparatus is suitable for depositing thicker coatings (85 to 95 microns as illustrated in Example 1 and Example 2 described in Indian Patent No. 209817) that possesses quite rough surface finish. Thereby the surface cleaning ability is poor and prone to dust accumulation;
4. the apparatus is not suitable for production scale as it is merely batch type processing based on the design of the electrolytic bath and also by the way that the bodies to be coated are arranged in the bath, which consumes a lot of time for fixing the bodies to be coated; and
5. the apparatus works with only two-phase electrical energy and leaves the third phase unutilized, therefore leading to electrical imbalance in the electrical mains.

Hence, it can be seen that there exists a need for providing a process for depositing uniform, thin films on sheets, foils and wires so as to enhance surface finish, thermal and electrical insulation, chemical inertness, surface cleaning ability, anti-dust sticking and to have good scratch resistance as well depositing in a continuous manner and also an apparatus for carrying out the process.

SUMMARY OF THE INVENTION

Therefore, the main object of the present invention is to propose a process for depositing uniform, adherent, thin ceramic films on sheets, foils and wires in a continuous manner without any interruption.

Another object of the present invention is to propose a process for protecting the sheets, foils and wires in particular made of aluminum and its alloys to protect them against thermal, chemical, electrical and environmental reactions.

Still another object of the present invention is to propose a process for depositing uniform, adherent, thin ceramic films on sheets, foils and wires which is simple and economical.

Another object of the present invention is to propose an apparatus for carrying out the process for depositing uniform, adherent, thin ceramic films on sheets, foils and wires on a rapid production scale.

Yet another object of the present invention is to propose an apparatus for carrying out the process without having a transformer in the electrical circuit so that the electrical waveforms modified by thyristors are not distorted and therefore the coatings deposited are more uniform and adherent.

Still another object of the present invention is to propose an apparatus for carrying out the process wherein all three-phases of the power supply are properly used for coating deposition so that production rates are higher and electrical imbalances are minimized.

The above objects of the present invention are achieved by providing a process involving electro-thermal and electrochemical oxidation of bodies in the form of sheets, foils or wires that continuously move in an alkaline electrolytic solution. In its broadest term, the present invention provides a new process for continuously electrolytically oxidizing metallic sheets, foils and wires.

BRIEF DESCRIPTION OF THE DRAWINGS

The present invention will be more fully understood from the following description taken in conjunction with the accompanying drawings wherein.

BRIEF DESCRIPTION OF THE INVENTION

Figure 1:
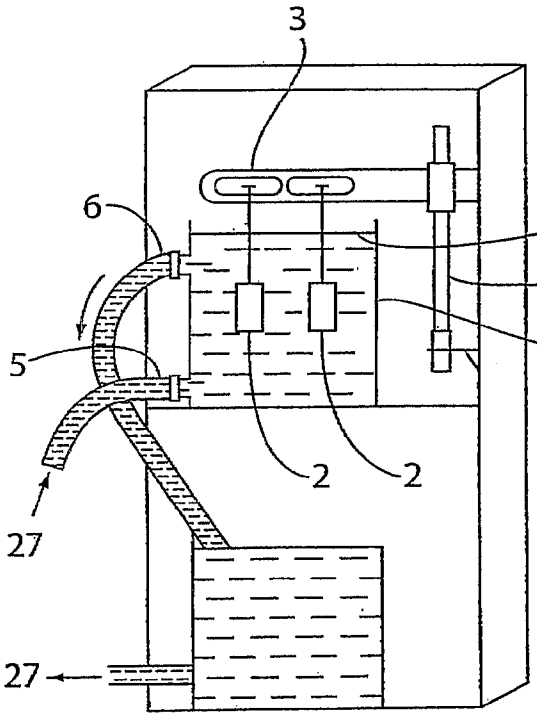
FIG. 1 represents a front view of a coating apparatus for carrying out the process disclosed in the prior art Indian patent.
Figure 2:
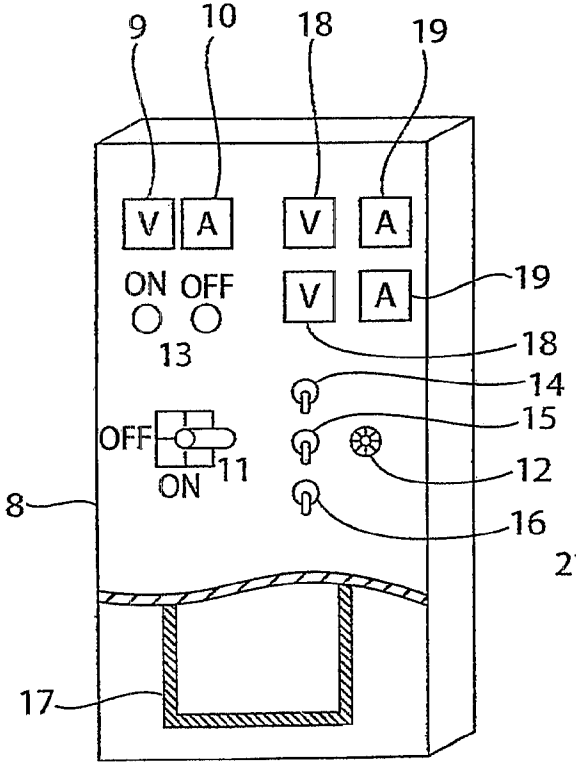
FIG. 2 represents a front view of a main control panel for carrying out the process disclosed in the patent.
Figure 3:
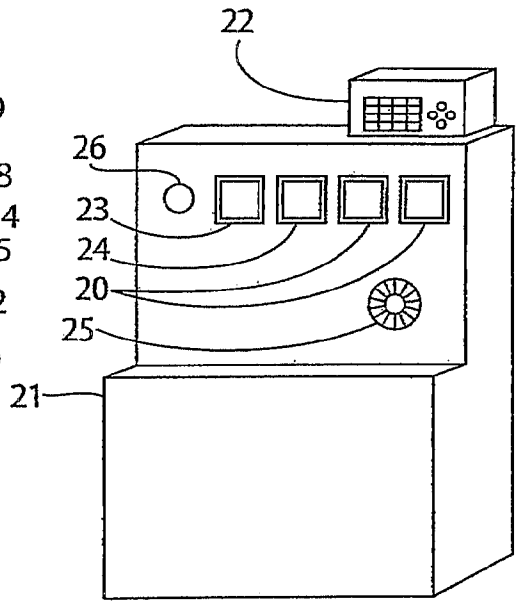
FIG. 3 represents a front view of a remote control panel for carrying out the process disclosed in the patent.
Figure 4:
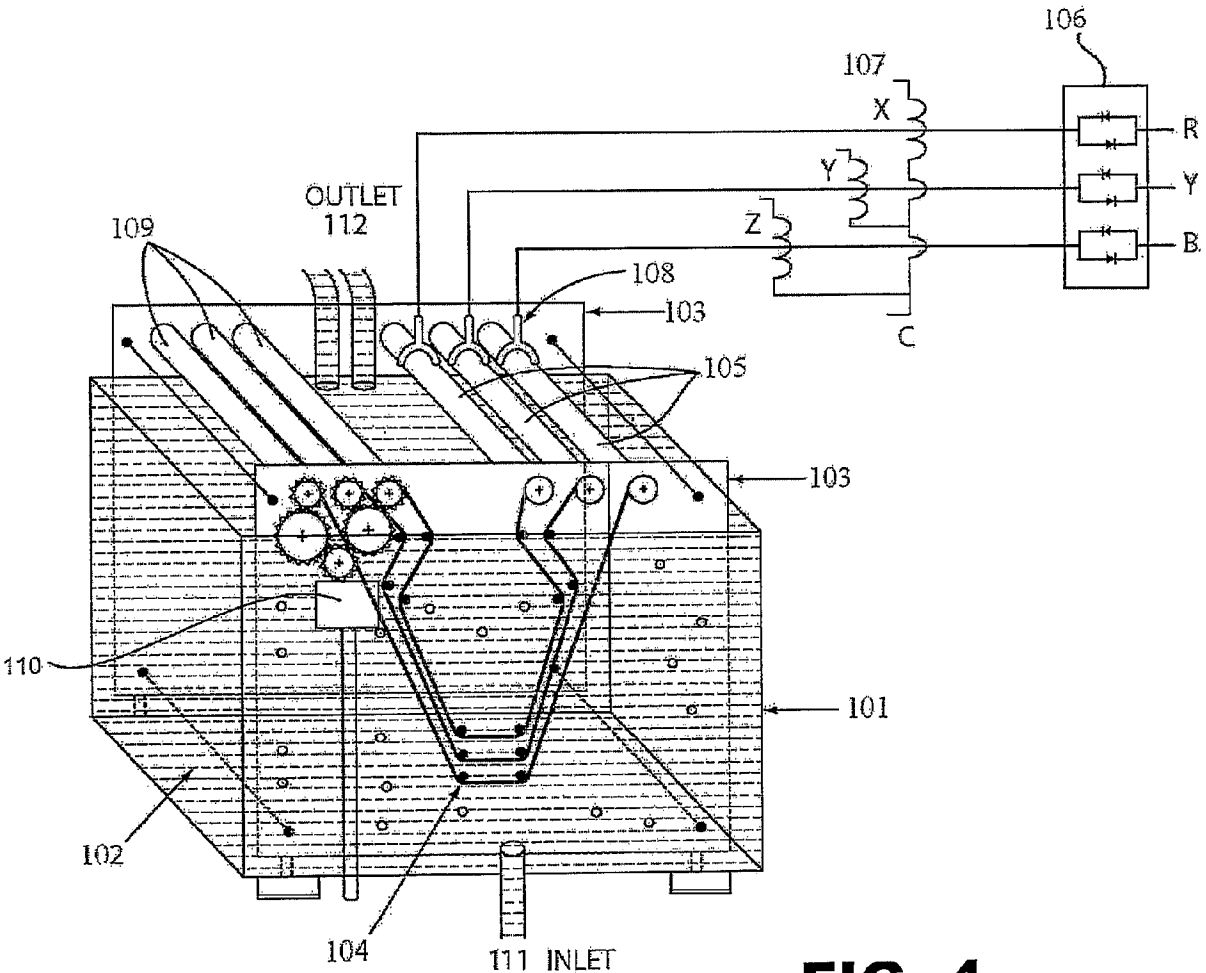
FIG. 4 represents a schematic diagram of an embodiment of the apparatus of the present invention.

Accordingly, the present invention provides an apparatus for continuously forming thin ceramic coatings on metal sheets, foils or wires (hereafter collectively referred to as metallic web). The apparatus comprises a reaction chamber (101) made up of a mild steel tank lined, both inside and outside, with Fibre Reinforced Plastic (FRP) for enhanced safety and to avoid any leakage of electrical energy. The reaction chamber (101) is capable of containing an alkaline electrolytic solution (102) tetrasilicate in de-ionized or distilled water. The reaction chamber (101) is provided with perforated nylon sheets (103), the sheets being attached to each other at each corner and being removably fixed and placed along the longitudinal walls of the reaction chamber (101). The nylon sheets (103) are also provided with three nylon bar guides (104) as well as three copper rods (105) that are able to rotate freely. Each of the copper rods (105) has a circular geometry and is separately connected to the R, Y and B phases of power supply, by high conductivity copper clamps (108) having a circular inner geometry. Each phase (R, Y and B Phases) is provided with two back-to-back thyristors (106) connected in parallel. The outputs of the thyristors (106) are connected to each of the copper rods (105) using three current transformers (CTs) (107). Three collecting nylon rods (109), each of which is capable of rotation by a drive means (110), are provided for collecting the metallic web after it is coated. The nylon rods (109) are attached at the top left portion of the nylon sheets (103). The chamber (101) also has an inlet (111) for the electrolyte provided at the bottom of the reaction chamber (101) and two outlets (112) for the electrolyte provided on the opposite side relative to the inlet side at the top of the reaction chamber (101).

By changing the location of the freely rotating nylon bars guides (104), either vertically or horizontally in the bath, it is possible to change the total surface area of the metallic web being coated without changing the basic design of the reaction chamber. This can be done by using the perforated nylon sheets (103) which permit the accommodation of more nylon bar guides (104) so that the webs to be coated can be passed in a zigzag manner to increase the residence time of the bodies in the bath, thus increasing the contact area of the metallic web which is to be coated with the electrolyte without necessitating any other design changes to the reaction chamber (101). Thereby, the overall productivity increases significantly and the rated power of the equipment is fully utilized. The coated web can be moved through the electrolyte solution (102) by drive means acting on one or more of the copper rods (105). Collecting nylon rods (109) are capable of rotating at a preset rpm by employing a drive (110) attached to the outer frame of reaction chamber (101) with the help of a conventional reduction gear system. The linear velocity of the metallic web, or in other words the residence time of the web inside the bath, is controlled by adjusting the rpm of the drive.

According to another feature of the invention, there is provided a process for forming coatings on metal sheets, foils or wires (hereafter collectively referred to as metallic web).

The process comprises immersing at least three metallic webs selected from the reactive group of metals on which coatings have to be effected, in an alkaline electrolytic solution having a pH>12 and conductivity>2 millimhos, the electrolytes solution comprising potassium hydroxide, sodium tetrasilicate in de-ionized or distilled water contained in the reaction chamber (101) of the device as defined above. Wave multiphase alternating current is passed across the web by the back-to-back thyristors connected in parallel for a period based on the desired thickness of the coatings to be achieved. The current being supplied to the web is slowly increased until the required current density is achieved. The flow of the electrolyte is in the direction perpendicular to the direction of the moving metallic web in such a way that cross flow is attained for effective heat dissipation in the reaction chamber. The current is maintained at the same level throughout the process. The electric potential is further increased gradually to compensate for the increasing resistance of the coating when visible arcing at the surface of the immersed regions of the said web is noticed. The composition of the electrolyte is regulated by measuring its pH and conductivity during the process by conventional methods. The temperature of the electrolyte is maintained between the range of 4° C. to 50° C. and the electrolyte is kept in continuous circulation throughout the process. The coated web is removed by taking out the perforated nylon sheets from the reaction chamber (101).

The electrolytic solution (102) enters the reaction chamber (101) through the inlet (111) provided at the bottom of reaction chamber (101) and leaves the reaction chamber (101) through two outlets (112) provided on the opposite side relative to inlet side at the top of the reaction chamber (101). A three-phase electrical power is supplied through two back-to-back thyristors (106) connected in parallel provided for each phase (R, Y and B Phases), which are employed for modifying the current and voltage waveforms. All the three phases of modified wave electrical power is then passed through three metallic webs to be coated leading to enhanced production rate and minimized electrical imbalances in the electrical mains. Three current transformers (CTs) (107) consisting of x, y, z and common point c are provided to the R, Y and B phases in the manner to separately measure the magnitude of current flowing in the three phases and the resultant averaged electrical signal is fed to the thyristor block (106) so that the constant current supply is provided throughout the coating deposition process.

In a preferred embodiment of the invention, the electrolyte used may contain potassium hydroxide and sodium tetrasilicate in a preferred ratio of 2:1. The web on which the deposition is to be made may he selected from the reactive group of metals consisting of Al, Ti, Mg, Zr, Ti, Be, Ge, Ca, Te, Hf, and V and their binary, ternary and multi-constituent alloys with elements like Cu, Zn, Mg, Fe, Cr, Co, Si, Mn, Al, Ti, Mg, Zr, Ta, Be, Ge, Ca, Te, Hf, V, and W.

The material of the web is allowed to move at a preset velocity by adjusting the speed of the drive (110). The linear velocity of the web is calculated based on the residence time in the bath required for depositing the required film thickness. The flow of electrolyte is in the direction perpendicular to the direction of the moving web in such a way that a cross flow is attained for effective heat dissipation in the reaction chamber (101). The flow rate of electrolyte in liters per minute is calculated based on the surface area of the web being coated in such a way that the ratio of total surface area (in sq. cm) to the flow rate (in liters per minute) is maintained between 0.1 and 1.2 so as to maintain a constant temperature of the bath. The electrolyte is circulated through an air cooled heat exchanger system so that the bath temperature is maintained constant. Accordingly, the cooled electrolyte enters the reaction chamber (101) through an inlet (111) provided at its bottom, and the hot electrolyte leaves through outlets (112) at the top of the chamber. Two back-to-back thyristors connected in parallel provided for each phase (R, Y and B Phases) are employed both for modifying the current and voltage waveforms. The firing angle of the thyristors is based on the feedback signal obtained by collecting the average value of electrical current passing through each individual phase and using this average value as a feedback signal thus maintaining the constant current supply throughout the process. The modified wave electrical power is passed through at least three webs to be coated or multiples of three webs. The magnitude of current is based on the contact surface area of the body to be coated with the electrolyte. The total time of power supply is based on the total length (in meters) of the web (sheet, foil or wire) being coated divided by the linear velocity (meters/seconds) of the body in the bath.

By carrying out the process as described above, it is possible to obtain thin films of predetermined thickness in the range of 0.25 to 10 microns on sheets and foils having a wide range of widths from 10 cm to 500 cm, and wires of varying diameters from 0.02 cm to 2.0 cm and over a total length of several kilometers without any interruption, providing superior quality coating and enhanced production rates. The thin films thus obtained by employing the above-described process have exhibited glossy surface finishes, thermal and electrical insulation, chemical-inertness, surface cleaning ability, anti-dust sticking and good scratch resistance. Further, the thin films produced by this method are more adherent, smooth and uniform than the coatings produced in the prior art.

The details of the invention are given in the Examples given below which are provided for illustrating the invention and therefore should not be construed to limit the scope of the present invention.

Example 1

Three high purity aluminum foils of each 68 mm width, 30 micron thickness and 500 meter long dimension were connected to an output of a power supply. A total surface area in contact with an electrolyte was adjusted to be about 2100 $cm^2$ and a three-phase current of 210 A was passed through each web and maintained constant throughout the process. The surface area of the web in contact was adjusted by adjusting the location of nylon bars. Electrolyte containing potassium hydroxide and sodium tetrasilicate in a ratio of 2:1 (4 g/l potassium hydroxide and 2 g/l sodium tetrasilicate) mixed in de-ionized water was circulated through the reaction chamber throughout the process. The electrolyte flow rate of 250 liters per minute was maintained throughout the process. The rpm of the drive is set at 550 revolutions per minute so that a linear velocity of 2.2 m/min was maintained constant throughout the process. The process was continued for a total duration of 3 hrs 50 minutes to coat a total foil of length equal to 1.5 kilometers resulting in a deposition of 0.5 micron thick film on a total surface area of 1,020,000 square centimeters. The films formed were found to have excellent adhesion, glossy surface finish, and high degree of uniformity without leaving any uncoated areas without any surface defects. In addition, the deposited films were found to be decorative, thermally and electrically insulative, chemically inert, exhibited easy surface cleaning ability, anti-dust sticking and were environmentally non-reactive.

Example 2

Nine electrical grade aluminum spools, each containing wires of 4 mm diameter, and 1000 meter (1 kilometer) long dimension were connected to an output of a power supply. A total surface area in contact with an electrolyte is adjusted to be about 2260 $cm^2$ and a three-phase current of 225 A was passed through each web and maintained constant throughout the process. The surface area of the web in contact was adjusted by adjusting the location and also by placing more nylon bars. In order to avoid the lateral movements, the wire was passed through individual non-metallic guides attached to nylon bars so that any possibility of electrical short circuit was completely eliminated. Electrolyte containing potassium hydroxide and sodium tetrasilicate in the ratio of 2:1 (4 g/l potassium hydroxide and 2 g/l sodium tetrasilicate) mixed in de-ionized water was circulated through the reaction chamber throughout the process. The electrolyte flow rate of 1200 liters per minute was maintained throughout the process. The rpm of the drive was set at 550 revolutions per minute so that a linear velocity of 2.7 m/min was maintained constant throughout the process. The process was continued for a total duration of 6 hrs to coat a total foil of length equal to 9 kilometers. The average film thickness was found to be 1.0 micron. The films formed were found to have excellent adhesion, glossy surface finish, high degree of uniformity without leaving any uncoated areas, without any surface defects. In addition, the deposited films were found to be decorative, thermally and electrically insulative, chemically inert, exhibited easy surface cleaning ability, anti-dust sticking and were environmentally non-reactive.

Example 3

Three aluminum alloy sheets having 136 mm width, 0.2 mm thickness have been subjected to similar processes as described in Example 1. The surface area of the web in contact with electrolyte was adjusted by adjusting a location of nylon bars. Electrolyte containing potassium hydroxide and sodium tetrasilicate in the ratio 2:1 (4 g/l potassium hydroxide and 2 g/1 sodium tetrasilicate) mixed in de-ionized water was circulated through the reaction chamber throughout the process. The electrolyte flow rate of 250 liters per minute was maintained throughout the process. The rpm of the drive is set so that a linear velocity of 0.22 m/min is maintained constant throughout the process. The process was continued for a total duration of 3 hrs 50 minutes to coat a total foil of length equal to 1.5 kilometers resulting in deposition of 5 micron thick film on a total surface area of 1,020,000 square centimeters. The applied current, electrolyte flow rate and treatment time were calculated accordingly and the films of 5 micron thickness were successfully deposited. The films were found to be uniform, homogeneous, environmentally non-reactive, and electrically and thermally insulative. Furthermore, the films formed have exhibited good scratch resistance as well.

It is apparent to a person reasonable skilled in the art that modifications and changes can be made within the spirit and scope of the present invention. Accordingly, such modifications and changes are also covered within the scope of the present invention.

ADVANTAGES OF THE INVENTION

1. The films obtained by the process using the apparatus of the present invention are uniform, exhibit glossy surface and are well bonded with the substrate.
2. The sheets, foils and wires prepared by the process using the apparatus of the present invention can be directly used for decorative, automobile, space, mild corrosion, anti-dust sticking, glossy/matt finishing, insulation, and mild chemical resistant applications.
3. The process using the apparatus described permits the continuous coating formation without intermediately stopping the process on the web of several kilometers long.
4. The process using the apparatus disclosed in the present invention permits the rapid rate formation of thin films on sheets, foils and wires.
5. The overall cost of film deposition on the web offered by the present invention is negligibly low compared to the coatings produced by the process hitherto known.
6. The web, in widely differing widths and thicknesses in the case of sheets and foils, or with different diameters in the case of wires, can be treated without any design changes in the apparatus disclosed in the present invention.

It is to be noted that the present invention is susceptible to modifications, adaptations and changes by those skilled in the art. Such variant embodiments employing the concepts and features of this invention are intended to be within the scope of the present invention, which is further set forth under the following claims.

We claim:

1. An apparatus for continuously forming thin ceramic coatings on metallic web, the apparatus comprising:
a reaction chamber; and
perforated sheets placed in the reaction chamber; and
a plurality of bar guides placed in the reaction chamber, wherein the location of the bar guides is changeable using the perforated sheets, which permit accommodation of the bar guides, to change a total surface area of the metallic web being coated.

2. The apparatus of claim 1, wherein the reaction chamber is capable of containing an alkaline electrolytic solution.

3. The apparatus of claim 1, wherein the perforated sheets are perforated nylon sheets.

4. The apparatus of claim 1, wherein the perforated sheets are attached to each other at each corner and are removably fixed and placed along longitudinal walls of the reaction chamber.

5. The apparatus of claim 1, wherein the bar guides are nylon bar guides.

6. The apparatus of claim 1, further comprising conductive rods that are able to rotate freely, each of the conductive rods having a circular geometry and being separately connected to an R, Y, or B phase of a power supply by high conductivity clamps having a circular inner geometry, each phase (R, Y or B Phase) being provided with two back-to-back thyristors connected in parallel, the outputs of the thyristors being connected to each of the conductive rods using current transformers (CTs).

7. The apparatus of claim 6, wherein the conductive rods and high conductivity clamps and copper rods and copper clamps.

8. The apparatus of claim 1, further comprising collecting rods provided for collecting the metallic web after being coated, wherein each collecting rod is capable of rotation and is attached at the top portion of the sheets.

9. The apparatus of claim 8, wherein the collecting rods are collecting nylon rods.

10. The apparatus of claim 1, further comprising an inlet for the electrolytic solution provided at the bottom of the reaction chamber and two outlets for the electrolytic solution provided on the opposite side relative to inlet side at the top of the reaction chamber.

11. An apparatus for continuously forming thin ceramic coatings on metallic web, the apparatus comprising: a reaction chamber, wherein the reaction chamber is capable of containing an alkaline electrolytic solution, the reaction chamber being provided with perforated nylon sheets, the nylon sheets being attached to each other at each corner and being removably fixed and placed along the longitudinal walls of the reaction chamber, the nylon sheets being provided with three nylon bar guides and three copper rods, wherein the copper rods are able to rotate freely, each of the copper rods having a circular geometry and being separately connected to an R, Y, or B phase of a power supply by high conductivity copper clamps having a circular inner geometry, each phase (R, Y or B Phase) being provided with two back-to-back thyristors connected in parallel, the outputs of the thyristors being connected to each of the copper rods using three current transformers (CTs), three collecting nylon rods provided for collecting the metallic web after being coated, wherein each collecting nylon rod is capable of rotation and is attached at the top portion of the nylon sheets, the reaction chamber also having an inlet for the electrolytic solution provided at the bottom of the reaction chamber and two outlets for the electrolytic solution provided on the opposite side relative to inlet side at the top of the reaction chamber.

12. The apparatus of claim 11, wherein the reaction chamber is comprised of a mild steel tank lined both inside and outside with Fibre Reinforced Plastic (FRP).

13. The apparatus of claim 11, wherein the electrolytic solution comprises potassium hydroxide and sodium tetrasilicate in de-ionized or distilled water.

14. The apparatus of claim 11, wherein the metallic web is metal sheets, foils, or wires.

15. An apparatus for continuously forming thin ceramic coatings on metal sheets, foils or wires hereafter collectively referred to as metallic web, the apparatus comprising: a reaction chamber comprised of a mild steel tank lined both inside and outside with Fibre Reinforced Plastic (FRP), wherein the reaction chamber is capable of containing an alkaline electrolytic solution comprising potassium hydroxide and sodium tetra silicate in de-ionized or distilled water, the reaction chamber being provided with perforated nylon sheets, the nylon sheets being attached to each other at each corner and being removably fixed and placed along the longitudinal walls of the reaction chamber, the nylon sheets being provided with three nylon bar guides and three copper rods, wherein the copper rods are able to rotate freely, each of the copper rods having a circular geometry and being separately connected to an R, Y, or B phase of a power supply by high conductivity copper clamps having a circular inner geometry, each phase (R, Y, or B phase) being provided with two back-to-back thyristors connected in parallel, the outputs of the thyristors being connected to each of the copper rods using three current transformers (CTs), three collecting nylon rods provided for collecting the metallic web after being coated, wherein each collecting nylon rod is capable of rotation and is attached at the top portion of the nylon sheets, the reaction chamber having an inlet for the electrolytic solution provided at the bottom of the reaction chamber and two outlets for the electrolytic solution provided on the opposite side relative to the inlet side at the top of the reaction chamber.

* * * * *